US010059549B1

(12) United States Patent
Wise

(10) Patent No.: US 10,059,549 B1
(45) Date of Patent: Aug. 28, 2018

(54) PAPER ROLL AND METHOD OF MANUFACTURING

(71) Applicant: Robert Wise, Penngrove, CA (US)

(72) Inventor: Robert Wise, Penngrove, CA (US)

( * ) Notice: Subject to any disclaimer, the term of this patent is extended or adjusted under 35 U.S.C. 154(b) by 0 days.

(21) Appl. No.: 15/640,772

(22) Filed: Jul. 3, 2017

Related U.S. Application Data

(63) Continuation-in-part of application No. 15/483,021, filed on Apr. 10, 2017.

(60) Provisional application No. 62/515,152, filed on Jun. 5, 2017.

(51) Int. Cl.
*B65H 18/28* (2006.01)
*A47K 10/16* (2006.01)

(52) U.S. Cl.
CPC ..... *B65H 18/28* (2013.01); *A47K 10/16* (2013.01)

(58) Field of Classification Search
CPC ..... B65H 18/28; A47K 10/16
USPC ..... 428/537.5
See application file for complete search history.

(56) References Cited

U.S. PATENT DOCUMENTS

| | | | | |
|---|---|---|---|---|
| 7,392,961 | B2 * | 7/2008 | McNeil | B65H 18/22 242/535.4 |
| 7,455,260 | B2 * | 11/2008 | McNeil | B65H 18/22 242/535.4 |
| 9,227,281 | B1 * | 1/2016 | Meadows | A47K 10/16 |
| 2007/0102559 | A1 * | 5/2007 | McNeil | B65H 18/26 242/526 |
| 2017/0183824 | A1 * | 6/2017 | McNeil | D21H 27/002 |

* cited by examiner

*Primary Examiner* — Leszek Kiliman
(74) *Attorney, Agent, or Firm* — Global Intellectual Property Agency, LLC; Daniel Enea

(57) ABSTRACT

A paper roll and method of manufacturing. The paper roll includes a plurality of sheets spirally wound forming a roll. The roll includes a first end and a second end, wherein the first end forms an inner section. The inner section defines an axial passageway that extends from a first side of the roll to a second side of the roll. An adhesive that can stiffen the inner section joins the plurality of sheets of the first end. The method for manufacturing the paper roll includes winding the plurality of sheets about a low-friction tube to form a roll, applying an adhesive to the plurality of sheets at a first end of the roll forming an inner section having an axial passageway, curing the adhesive configured to stiffen the inner section, and removing the low-friction tube from the roll.

24 Claims, 4 Drawing Sheets

PAPER ROLL AND METHOD OF MANUFACTURING

CROSS REFERENCE TO RELATED APPLICATIONS

This application is a continuation-in-part and claims the benefit of U.S. application Ser. No. 15/483,021 filed on Apr. 10, 2017 and claims the benefit of U.S. Provisional Application No. 62/515,152 filed on Jun. 5, 2017. The above identified patent application is herein incorporated by reference in its entirety to provide continuity of disclosure.

BACKGROUND OF THE INVENTION

The present invention relates to paper rolls and methods of manufacturing paper rolls. Specifically, it relates to paper rolls having a rigid inner section wherein the rigid inner section loses rigidity when in contact with water and methods of manufacturing same.

Many people rely on paper rolls of various types or styles to clean themselves after using the bathroom. Large quantities of paper rolls are being consumed on a daily basis across the world. As traditional paper rolls are rolled around a rigid cardboard core, this leads to excessive amounts of waste generated, as the rigid cores are thrown away and crowd landfills. Additionally, costs of manufacturing and shipping these cardboard cores increase the overall costs of manufacturing a paper roll.

Previous attempts to cost and environmental concerns of a paper roll having a core have been partially successful, however some problems are left unaddressed. One product uses a rigid cardboard tube as a core that is made of a biodegradable material to minimize waste generation. However, leaves a costly additional step in the manufacturing process of creating and transporting the cardboard tube. Another product eschews the cardboard tube in favor of adhering the inner layers of the roll together to create a coreless paper roll, however these paper rolls collapse under the weight of the paper, leading to difficulty in unrolling the paper for use. Therefore, a paper roll that eliminates environmental waste and minimizes manufacturing costs, while still providing a convenient to use paper roll is needed.

In light of the devices disclosed in the known art, it is submitted that the present invention substantially diverges in design elements from the known art and consequently it is clear that there is a need in the art for an improvement to existing paper rolls and methods of manufacturing same. In this regard, the instant invention substantially fulfills these needs.

SUMMARY OF THE INVENTION

In view of the foregoing disadvantages inherent in the known types of paper rolls now present in the prior art, the present invention provides a paper roll and a method of manufacturing paper rolls wherein the same can be utilized for providing convenience for the user when disposing of and manufacturing paper rolls.

The present system comprises a plurality of sheets spirally wound about an axis to form a roll. The roll comprises a first end and a second end, wherein the first end forms an inner section. The inner section defines an axial passageway extending from a first side of the roll to a second side of the roll. The plurality of sheets of the first end, making up the inner section, are bonded together by an adhesive, wherein the adhesive is configured to stiffen the inner section. In some embodiments, the adhesive is configured to degrade when in contact with water. In another embodiment, the adhesive is configured to stiffen the inner section to be at least twice as rigid as the second end. In other embodiments, the adjacent sheets of the plurality of sheets are divided by perforations. In yet another embodiment, the inner section comprises 4-6 layers of the plurality of sheets. In some embodiments, the axial passageway comprises a substantially circular cross-sectional shape. In another embodiment, the adhesive further comprises a fragrance agent. In other embodiments, the fragrance agent is configured to emit a scent when exposed to air. In yet another embodiment, the fragrance agent is configured to emit a scent when in contact with water. In some embodiments, the adhesive further comprises a disinfectant configured to sanitize a container having a volume of water therein, such as a toilet bowl. In another embodiment, the adhesive comprises polyvinyl alcohol. In other embodiments, the plurality of sheets further comprises textured elements thereon. In yet another embodiment, the inner section further comprises corrugation configured to provide rigidity thereto.

The present method comprises winding a plurality of sheets about a low-friction tube to form a roll, applying adhesive to the plurality of sheets at a first end of the roll to form an inner section having an axial passageway, curing the adhesive to provide rigidity to the inner section, and removing the low-friction tube from the roll. In some embodiments, the low-friction tube comprises a tubular platen having a plurality of recesses disposed about an outer surface thereof, wherein each of the plurality of recesses comprises an aperture therein. In other embodiments, the method further comprises circulating air through the tubular platen such that negative pressure is generated at the apertures, thereby securing the plurality of sheets to the tubular platen. In another embodiment, the temperature of the air circulated through the tubular platen is configured to decrease curing time of the applied adhesive. In other embodiments, the method further comprises generating positive pressure at the plurality of recesses to remove the roll from the tubular platen. In yet another embodiment, the method further comprises cutting the roll to a desired length. In some embodiments, the method further comprises packaging the roll for distribution. In another embodiment, the adhesive further comprises a fragrance agent. In other embodiments, the adhesive further comprises a disinfectant. In yet another embodiment, the method further comprises determining the desired thickness of the roll. In some embodiments, the method further comprises applying adhesive to additional layers of the first end to increase the rigidity of the inner section.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
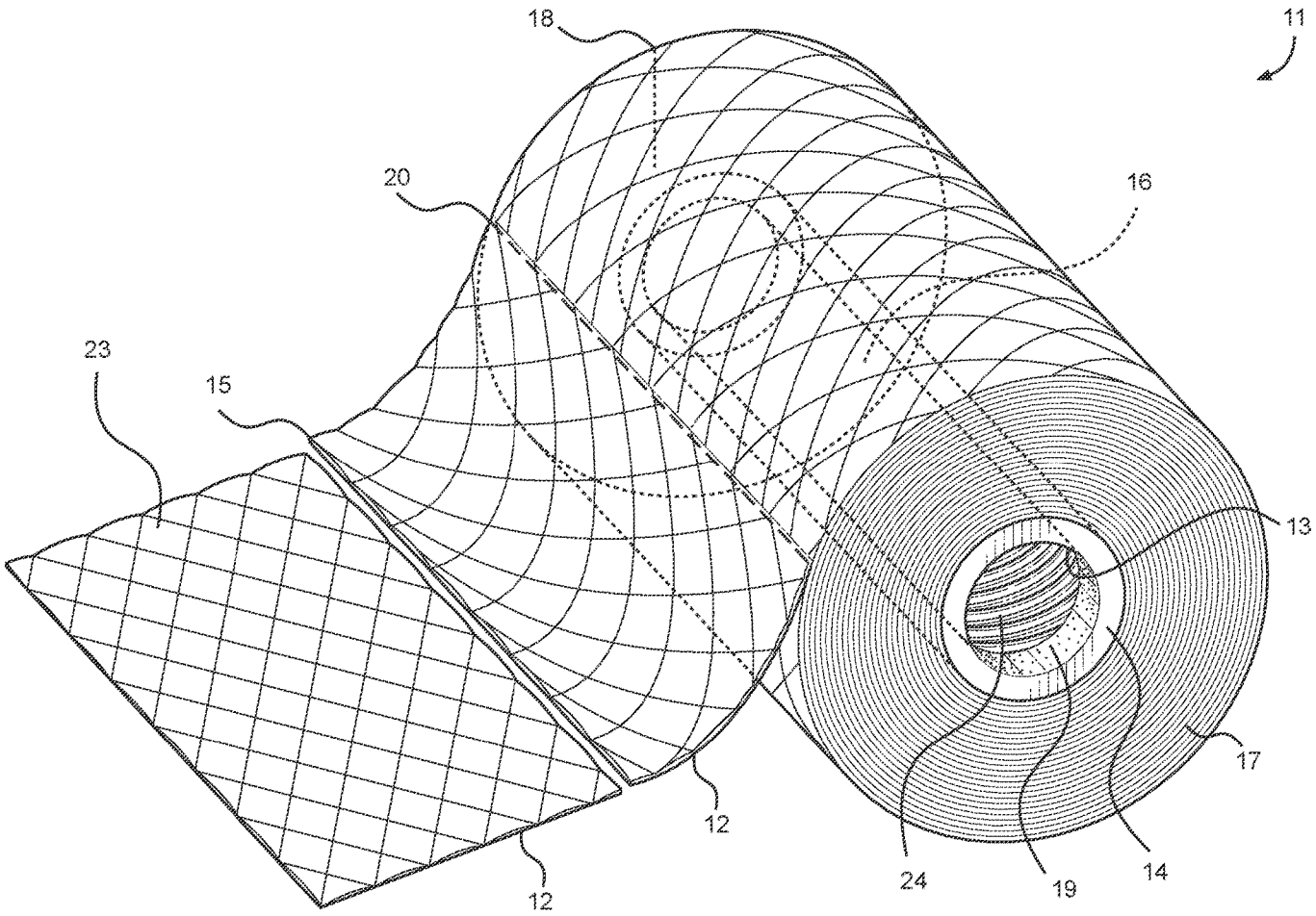
FIG. 1 shows a perspective view of an embodiment of the paper roll.

Reference is made herein to the attached drawings. Like reference numerals are used throughout the drawings to depict like or similar elements of the paper roll. The figures are intended for representative purposes only and should not be considered to be limiting in any respect.

It should be noted that the discussion below focuses on an embodiment of the paper roll wherein the paper roll comprises a roll of toilet paper, however the paper roll described below can be a paper material including but not limited to tissue paper, toilet paper, paper towels, and the like. Thus, the type of paper material should not be used to restrict the scope of the paper roll.

Referring now to FIG. 1, there is shown a perspective view of an embodiment of the paper roll. The paper roll comprises a plurality of sheets 12 spirally wound to form a roll 11 having a first end 13 and a second end 15, wherein the second end 15 comprises the outer terminal end of the roll 11. In the illustrated embodiment, the plurality of sheets 12 further comprise perforations 20 extending along the length of the plurality of sheets 12. The perforations 20 are disposed between adjacent sheets and are configured to allow a user to separate adjacent sheets. In some embodiments, the plurality of sheets 12 further comprise textured elements 23 thereon. The textured elements 23 are configured to increase the surface area in contact with a user, thereby aiding in cleaning the area as more dirt can be accumulated thereon. Additionally, the textured elements 23 provide a pleasant sensation and increase comfort for the user. In the illustrated embodiment, the plurality of sheets 12 comprise a single ply, however in alternate embodiments, the plurality of sheets 12 comprise a plurality of plies.

The first end 13 forms an inner section 14 of the roll 11. The inner section 14 comprises several layers of plurality of sheets 12 of the first end 13 bonded together by an adhesive 19 to provide rigidity to the inner section 14. This provides the roll 11 with structural integrity similar to that provided by a traditional cardboard tube. In some embodiments, the inner section 14 further comprises a corrugated inner surface 24. The corrugated inner surface 24 is formed as the plurality of sheets 12 are layered together and is configured to provide additional strength and rigidity to the inner section 14.

In the illustrated embodiment, the inner section 14 forms an axial passageway 16 extending between a first side 17 and a second side 18 of the roll 11. The axial passageway 16 is configured to receive a rod (shown in FIG. 3, 25) therethrough, such as a toilet paper holder. In the illustrated embodiment, the axial passageway 16 comprises a substantially circular cross-sectional shape. In this way, the axial passageway is configured to allow a user to evenly dispense the plurality of sheets 12 from the roll 11 as the roll 11 rotates about the rod smoothly. In alternate embodiments, the axial passageway 16 can comprise various other shapes, so long as the width of the axial passageway 16 is sufficient to receive a rod therethrough.

In the illustrated embodiment, the inner section 14 is bonded by an adhesive 19. The adhesive 19 is configured to penetrate through several layers of the plurality of sheets 12. These bonded layers stiffen the inner section 14 to provide structural integrity to the roll 11 such that the roll 11 does not collapse under its own weight. In some embodiments, the adhesive 19 is configured to penetrate four to six layers of the plurality of sheets 12. In another embodiment, the adhesive 19 is configured to increase the rigidity of the inner section 14 to at least twice that of the second end 15. The adhesive 19 is further configured to degrade when in contact with water. In this way, the inner section 14 loses its rigid properties, regaining the physical properties of the plurality of sheets 12. This allows the inner center 14 to be disposed of similarly to the plurality of sheets 12, such as via flushing into a toilet. In some embodiments, the adhesive 19 comprises polyvinyl alcohol.

In some embodiments, the adhesive 19 further comprises a fragrance agent configured to emit a scent when exposed to air or water. In this way, when the roll 11 is rotated about the rod, the fragrance agent is activated by the increased airflow through the axial passageway 16, causing a pleasant scent to be emitted from the inner section 14. Furthermore, when the user disposes of the inner section 14 in a toilet, the fragrance agent is activated when it contacts the water, releasing a pleasant scent. In another embodiment, the adhesive 19 further comprises a disinfectant configured to sanitize a container having a volume of water therein, such as a toilet bowl, after a predetermined amount of time in contact with the water. In some embodiments, the amount of time required to sanitize the container is greater than that required to degrade the adhesive 19. In this way, the disinfectant provides an efficient and simple means of cleaning the container.

Figure 2:
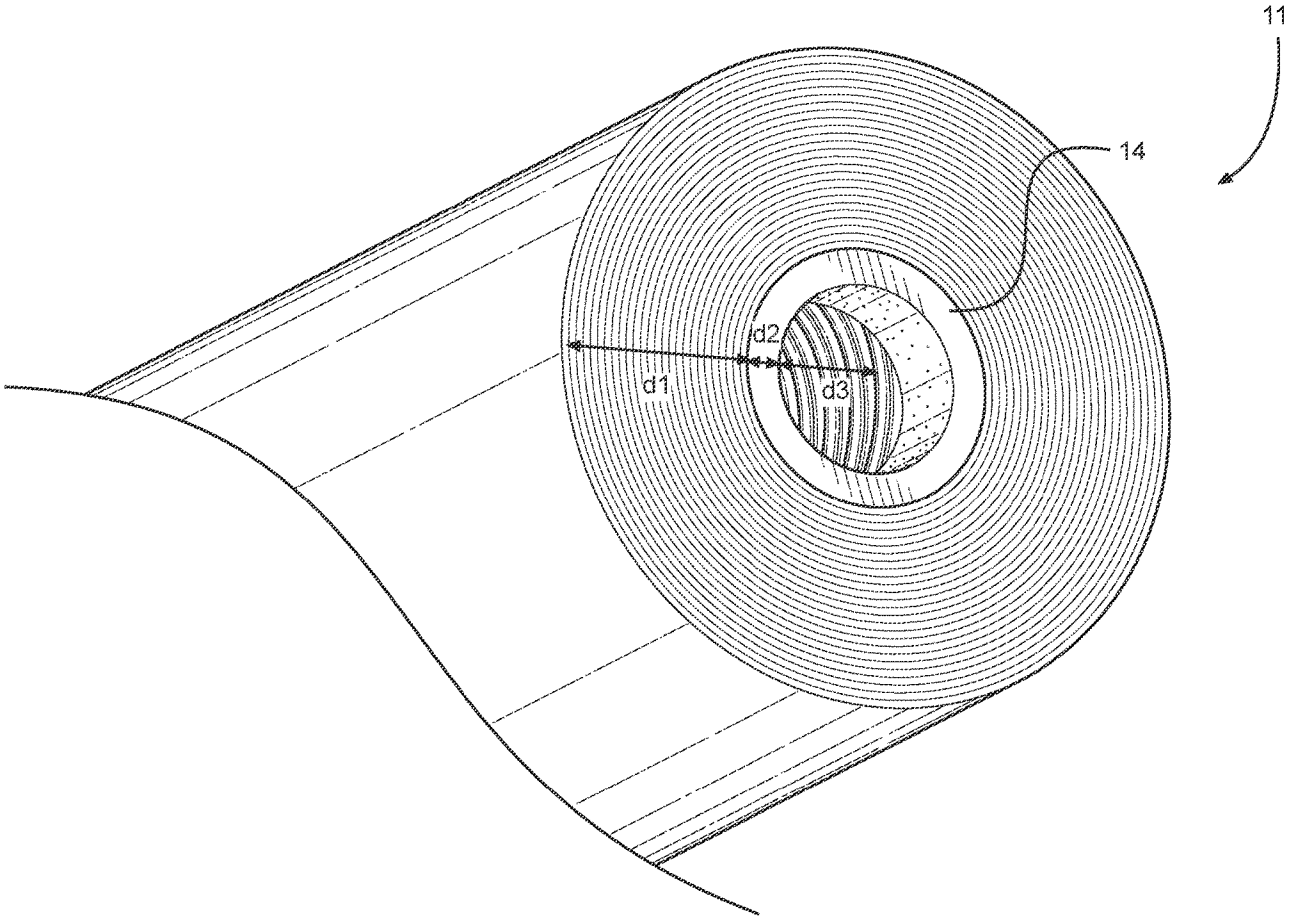
FIG. 2 shows a side view of an embodiment of the paper roll.

Referring now to FIG. 2, there is shown a side view of an embodiment of the paper roll. In the illustrated embodiment, the inner section 14 comprises a thickness d2. In order to support larger rolls 11, the thickness d2 increases relative to increases in a final width d1 of the roll 11. The final width d1 comprises the desired width of the plurality of sheets comprising the roll 11 at the end of manufacturing. In this way, the inner section 14 is configured to provide increased rigidity to support the added weight of larger final widths d1 of the roll 11. The internal radius d3 of the inner section 14 comprises the radius of the axial passageway. The internal radius d3 is configured to fit the rod therethrough.

To increase the thickness d2 of the inner section 14, an additional layer of the adhesive is applied to the plurality of sheets during the manufacturing process, such that the adhesive penetrates further layers of the plurality of sheets. As the adhesive cures, the rigidity and strength of the inner section 14 increases. In this way, the inner section 14 can support increased weight and stress without failing. This process can be repeated as desired to achieve the desired rigidity as required by the desired final width d1.

Referring to FIGS. 1 and 2, in one use, a user takes a number of the plurality of sheets 12 from the roll 11 by tearing one or more of the sheets from an adjacent sheet along the perforations 20. As the roll 11 is rotated about the rod holding the roll 11 in place, the fragrance agent is activated by the increased airflow through the axial passageway 16. The user then uses the removed sheet to clean himself and disposes of the removed sheet into a toilet bowl. Should the user reach the inner section 14 of the roll 11, the user can then dispose of the inner section 14 by placing it in the toilet bowl. The adhesive 19 then begins to degrade after contacting the water within the toilet bowl, which causes the inner section 14 to lose rigidity. After a set time, the adhesive 19 fully degrades. At this point the inner section 14 comprises the same physical properties of the plurality of sheets 12, such that it can be disposed of in a similar manner, such as by flushing in a toilet. In some embodiments, upon contact with the water within the toilet bowl, the fragrance agent within the adhesive 19 activates, emitting a scent therefrom. In another embodiment, a disinfectant within the adhesive 19 is activated when contacting the water of the toilet bowl. The disinfectant is configured to sanitize the toilet bowl after a set time.

Figure 3:
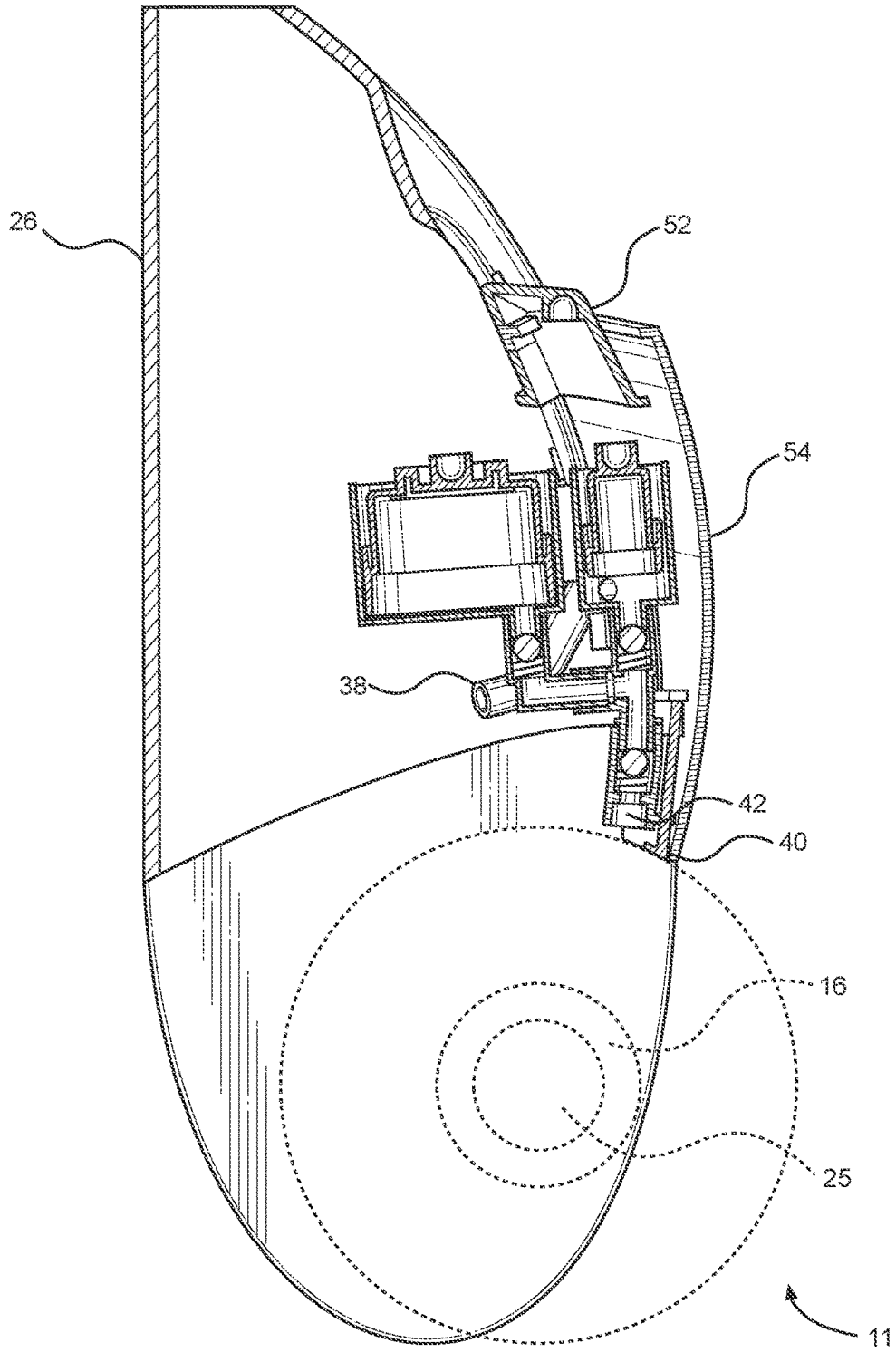
FIG. 3 shows a side view of an embodiment of the paper roll in a dispenser.

Referring now to FIG. 3, there is shown a side view of an embodiment of the paper roll in a dispenser. In the illustrated embodiment, the roll 11 is mounted within a dispenser 26. The rod 25 is inserted through the axial passageway 16 of the roll 11. The rod 25 engages with opposing ends of the dispenser 26 in order to hold the roll 11 in place. The roll 11 is configured to rotate about the rod 25. In one use, a user removes a desired number of sheets from the roll 11. The dispenser 26 dispenses a fluid onto the plurality of sheets as they are detected by the dispenser 26 as being removed.

Figure 4:
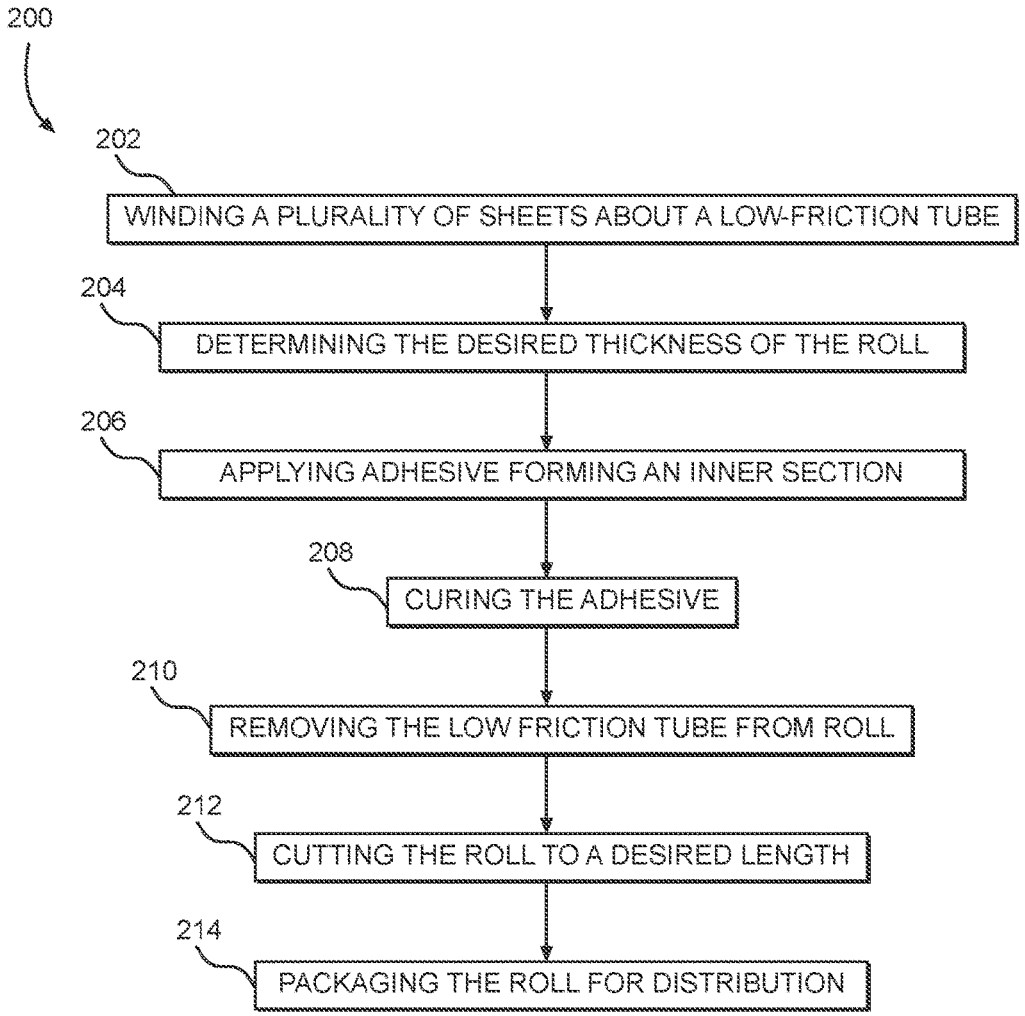
FIG. 4 shows a flow diagram of an embodiment of the method of manufacturing a paper roll.

Referring now to FIG. 4, there is shown a flow diagram of an embodiment of the method of manufacturing a paper roll. The method of manufacturing a paper roll 200 comprises winding a plurality of sheets about a low friction node 202. A plurality of sheets are wound 202 about a low-friction tube to create a spirally wound roll having a first end in contact with the low-friction tube, the first end forming an inner section of the roll, and a second end disposed on the outside of the roll. In some embodiments, winding 202 the plurality of sheets further comprises pressing textured elements, such as, but not limited to, a quilted pattern, into the plurality of sheets as the roll is formed. In another embodiment, perforations are cut into the plurality of sheets across the length thereof. In this way, adjacent sheets of the plurality of sheets can be separated about the perforations.

In some embodiments, the low-friction tube comprises a tubular platen having a plurality of recesses thereon, wherein each of the plurality of recesses comprises an aperture therein. In this embodiment, air is circulated through the tubular platen such that negative pressure is generated at the apertures, thereby securing the plurality of sheets to the tubular platen for rolling. Additionally, as the plurality of sheets are layered on top of each other, the plurality of recesses form a void space between layers such that a corrugated texture is formed in the inner section of the roll. This corrugated pattern adds structural integrity to the roll.

The method of manufacturing the paper roll further comprises determining the desired thickness of the roll 204. At this time, a user determines 204 the overall desired size and thickness of the roll to be manufactured. The larger the roll, the greater the stresses placed on the inner section of the roll, and therefore, the greater the required strength and rigidity of the inner section to resist those stresses.

An adhesive is then applied to the roll to form an inner section 206. The adhesive is applied 206 during the winding 202 process, such that multiple layers of the plurality of sheets are bonded together. In some embodiments, the adhesive is configured to penetrate and bond 4-6 adjacent layers of the plurality of sheets. If the inner section requires increased strength and rigidity to counteract the weight of the roll, additional layers of adhesive can be applied 206 such that the thickness of the inner section is increased. In this way, the thickness of the inner section can be increased by an additional 4-6 layers of the plurality of sheets each time a new layer of adhesive is applied 206.

Once the desired thickness of the inner section is achieved, the adhesive is then cured 208. In one embodiment, curing the adhesive 208 comprises allowing the inner section to dry over time. In some embodiments, the temperature of the air circulated through the tubular platen is configured to decrease the curing 208 time of the adhesive applied. In this way, the curing 208 process can be completed more efficiently.

The winding 202 stops once the desired size of roll is reached. At this point, the curing 208 process is complete and the low-friction tube is removed 210 from the roll. In some embodiments, once removed from the low-friction tube, the method 200 further comprises cutting the roll to a desired length 212. In another embodiment, the method 200 further comprises packaging the roll for distribution 214.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paper roll, comprising:

a plurality of sheets spirally wound forming a roll, the roll comprising a first end forming an inner section and a second end;

the inner section defining an axial passageway that extends from a first side of the roll to a second side of the roll;

an adhesive joining the plurality of sheets of the first end, wherein the adhesive is configured to stiffen the inner section; the inner section comprising at least two sheets of the plurality of sheets.

2. The paper roll of claim 1, wherein the adhesive is configured to degrade when in contact with water.

3. The paper roll of claim 1, wherein the adhesive is configured to stiffen the inner section to be at least twice as rigid as the second end.

4. The paper roll of claim 1, wherein adjacent sheets of the plurality of sheets are divided by perforations.

5. The paper roll of claim 1, wherein the inner section comprises 4-6 layers of the plurality of sheets.

6. The paper roll of claim 1, wherein the axial passageway comprises a substantially circular cross-sectional shape.

7. The paper roll of claim 1, wherein the adhesive further comprises a fragrance agent.

8. The paper roll of claim 7, wherein the fragrance agent is configured to emit a scent when exposed to air.

9. The paper roll of claim 7, wherein the fragrance agent is configured to emit a scent when in contact with water.

10. The paper roll of claim 1, wherein the adhesive further comprises a disinfectant configured to sanitize a container having a volume of water therein.

11. The paper roll of claim 1, wherein the adhesive comprises polyvinyl alcohol.

12. The paper roll of claim 1, wherein the plurality of sheets further comprises textured elements thereon.

13. The paper roll of claim 1, wherein the inner section further comprises corrugation configured to provide rigidity thereto.

14. A method of manufacturing a paper roll, comprising:

winding a plurality of sheets about a low-friction tube to form a roll;

applying an adhesive to the plurality of sheets at a first end of the roll forming an inner section having an axial passageway; the inner section comprising at least two sheets of the plurality of sheets;

curing the adhesive, wherein the adhesive is configured to stiffen the inner section;

removing the low-friction tube from the roll.

15. The method of manufacturing the paper roll of claim 14, wherein the low-friction tube comprises a tubular platen having a plurality of recesses disposed about an outer surface thereof, wherein each of the plurality of recesses comprise an aperture therein.

16. The method of manufacturing the paper roll of claim 15, further comprising circulating air through the tubular platen such that negative pressure is generated at the plurality of recesses.

17. The method of manufacturing the paper roll of claim 16, wherein the temperature of the air circulated through the tubular platen is configured to decrease curing time of the applied adhesive.

18. The method of manufacturing the paper roll of claim 15, further comprising generating positive pressure at the plurality of recesses to remove the roll from the tubular platen.

19. The method of manufacturing the paper roll of claim 14, further comprising cutting the roll to a desired length.

20. The method of manufacturing the paper roll of claim 14, further comprising packaging the roll for distribution.

21. The method of manufacturing the paper roll of claim 14, wherein the adhesive further comprises a fragrance agent.

22. The method of manufacturing the paper roll of claim 14, wherein the adhesive further comprises a disinfectant.

23. The method of manufacturing the paper roll of claim 14, further comprising determining the desired thickness of the roll.

24. The method of manufacturing the paper roll of claim 22, further comprising applying adhesive to additional layers of the first end to increase the rigidity of the inner section.

* * * * *